US007279087B2

(12) United States Patent
Maeuser

(10) Patent No.: US 7,279,087 B2
(45) Date of Patent: Oct. 9, 2007

(54) METHOD FOR PROTECTING METAL-CONTAINING STRUCTURES, DEPOSITED ON SUBSTRATE AGAINST CORROSION

(75) Inventor: Helmut Maeuser, Herzogenrath (DE)

(73) Assignee: Saint-Gobain Glass France, Courbevoie (FR)

( * ) Notice: Subject to any disclaimer, the term of this patent is extended or adjusted under 35 U.S.C. 154(b) by 133 days.

(21) Appl. No.: 10/541,396

(22) PCT Filed: Jan. 7, 2004

(86) PCT No.: PCT/FR2004/000013

§ 371 (c)(1),
(2), (4) Date: Jul. 1, 2005

(87) PCT Pub. No.: WO2004/070084

PCT Pub. Date: Aug. 19, 2004

(65) Prior Publication Data

US 2006/0231416 A1 Oct. 19, 2006

(30) Foreign Application Priority Data

Jan. 9, 2003 (DE) ..... 103 00 388

(51) Int. Cl.
*C23F 13/00* (2006.01)

(52) U.S. Cl. ..... 205/734; 205/735; 205/736; 205/740; 205/727; 205/730

(58) Field of Classification Search ..... 205/734, 205/740, 727, 730
See application file for complete search history.

(56) References Cited

U.S. PATENT DOCUMENTS 4,080,565 A 3/1978 Polak et al.
4,409,080 A * 10/1983 Slough ..... 204/196.06
5,750,071 A * 5/1998 Fiorino et al. ..... 205/724

FOREIGN PATENT DOCUMENTS

WO 00/45145 8/2000
WO 01/07683 2/2001

* cited by examiner

*Primary Examiner*—Bruce F. Bell
(74) *Attorney, Agent, or Firm*—Oblon, Spivak, McClelland, Maier & Neustadt, P.C.

(57) ABSTRACT

A method for protecting metal-containing structures, in particular electrically conductive structures, deposited on a substrate, against corrosive attacks, in particular electrocorrosion attacks. The method applies at least temporarily to the structure a passivation electric voltage in the passivation range of the conductive material concerned.

10 Claims, No Drawings

METHOD FOR PROTECTING METAL-CONTAINING STRUCTURES, DEPOSITED ON SUBSTRATE AGAINST CORROSION

The invention relates to a method for protecting metal-containing structures, in particular electric conductor tracks, applied to substrates against corrosion.

It is generally known that structures of electric conductor tracks or conductor arrays are applied for various purposes to motor vehicle window panes, which generally consist of glass but are increasingly also produced from plastics (for example polycarbonate). They are used as antennas, heating arrays, sensors or the like. Again, rain sensors are prior art in the construction sector, in particular in the case of glass roofing. Such structures are also used, for example, on toughened glass panes as breakage sensors (closed circuit loops) for interior applications.

The said structures are generally produced on a large industrial scale and fired onto glass substrates by screen printing of a firing-on paste with a high silver content. The firing on is mostly associated with heating the glass pane up for the purpose of bending and subsequent toughening if it is a monolithic glass pane.

If such conductor structures are arranged on the outside of the window pane, as is the case with moisture or rain sensors, in particular, corrosive phenomena can occur after lengthy exposed use in weather conditions. Various protective measures have already been proposed for this purpose.

Thus, DE-A 2 231 095 describes the application of a dielectric material (coating) over conductor structures which are used on the surface of a glass pane as heating conductors. DE-C1-100 15 430 describes a capacitively operating sensor for detecting condensates on the surface of a glass pane, a dielectric passivation layer being applied to the electrodes of said sensor. The application of an additional layer in a targeted fashion over the already fired-on structure is, however, an intermediate step which is very obstructive, time consuming and labour intensive, the more so as it must be carried out with high precision. If such a sensor lies, for example, in the wiping area of vehicle screen wipers, the protective layer becomes worn in the course of time and must be renewed, if appropriate.

It is known per se that metals can be effectively protected against electrical corrosion by the application of an electric voltage. Documentation on this topic is available at the Internet link: http://docserver.bis.uni-oldenburg.de/publikationen/dissertation/2000/ducper00/pdf/kap02.pdf. This is an extract (Chapter 2) of the German thesis "Periodic and chaotic oscillation phenomena on metal electrodes and electrochemical model experiments for nerve stimulus conduction" by Matthias Ducci, 2000, IX, 268 S.+video sequences on CD-ROM, Oldenburg University, 2000. It is stated that for the protection of iron against corrosion, by applying a sufficiently high external electric voltage the metal is set at a mixed potential which is higher than a passivation potential to be determined for the material. Once passivation has been introduced, this state can be maintained with a very low current density. The passivation current density may be comparable to the corrosion current density and is 10 $\mu A/cm^2$ for iron, while the passivation current density is approximately 0.2 $A/cm^2$.

WO-A1-01/07 683 describes an appropriate application for protecting concrete reinforcements made from steel against corrosion. An anode system is used to feed a controlled low DC voltage into the steel reinforcement, in order to cancel differences in the surface potential and to provide a uniform potential, the result being to prevent corrosion.

In other known applications, an AC voltage is proposed for passivating metals against corrosion. However, it has been observed in the case of steels that corrosion proceeds more quickly with an AC passivation voltage than when use is made of a DC voltage. This is explained by the fact that the AC voltage degrades the passive surface layer.

However, it has also been observed that with rising frequency of the AC voltage the tendency to corrosion of the structure subjected to the voltage increases and/or that the protective effect is improved. This is explained by the fact that the change in polarity of the current direction proceeds more quickly than the diffusion of the corrosive charge carriers by the passive layer.

The level of the passivation voltage must be determined individually for the material to be protected against corrosion. As a rule, a distinct passivation range can be determined as a function of the level of the external or passivation voltage, in which area the corrosion current is minimized (in proportion to the rate of metal dissolution) or, as appropriate, vanishes, which means that corrosion no longer takes place. In the case of excessively low external voltages, a sufficiently corrosion-inhibiting effect is not achieved ("active" range), while in the case of excessively high voltages (above the "breakdown potential") a so-called "transpassive" state occurs in which the protective effect fails and the corrosion current rises significantly again.

The application of this electric passivation is known on the whole for steel construction in buildings.

It is the object of the invention to specify a method for protecting metal-containing structures, exposed to weather, on substrates, in particular on glass panes, against weather-induced corrosion, which method can render an additional passivating coating of the electrically conductive structures superfluous.

This object is achieved according to the invention with the aid of the features of Patent claim 1. The features of the subclaims specify advantageous developments of this method and of its applications.

The invention is based on the consideration that even the conductive surface structures discussed at the beginning could be systems which can be passivated with metals, in particular silver and could be protected against corrosion by applying a suitable electric voltage.

It has actually been found in a series of experiments that the materials used industrially for structures printed onto glass or plastic panes, such as moisture sensors, antenna conductors and heating conductors, specifically a screen-printing paste made from a glass frit with a high silver content, can be protected effectively against rapid corrosion by applying both a DC voltage and an AC voltage. However, it is not mandatory to leave the passivation voltage applied at the electrodes continuously.

It is the arrangement of the conductor structure which is decisive. The electric passivation and thus the active protection against corrosion require a potential difference between two electric conductors at the level of the passivation voltage which are closely neighbouring on the substrate surface itself or in another way and are not electrically interconnected. This can be implemented with particular ease in the case of capacitively operating sensors. However, other cases of application, for example antenna structures, which can likewise be capacitively coupled, can also be passivated using the method described here given a suitable spatial arrangement in relation to an opposite pole. Thus, for example, a system having a signal conductor which is guided parallel to an earthing bar (earth or +12 V) can be passivated by the selection of a suitable signal amplitude and, if appropriate, frequency.

To date, it has been customary and (in accordance with specific manufacturers' test standards) permissible to mask printed conductor structures present on the vehicle glass panes to be tested in order not to expose them to artificial aggressive weathering when carrying out the salt spray test in accordance with DIN 50021, because it must be assumed that these structures will certainly be destroyed given the intensified, corrosive effects for the entire test conditions simulating component service life.

After the said test was carried out on a number of test patterns to which a passivation voltage was applied while the test was being carried out, only relatively mild corrosion phenomena were to be noted on visual assessment even after 240 hours of exposure. This corrosion did not, however, lead to a complete functional failure of the relevant structure.

The possible electric passivation by application of a relatively low electric (AC) voltage opens up the possibility of being able to make cost effective use of silver-containing conductor structures produced by screen printing on substrates, in particular on glass, even in those external applications where to date either the known measures against corrosion have been necessary, or the structures have been dispensed with in favour of other solutions (for example optical or capacitive sensors behind a glass pane). The protecting effect of the application of an electric voltage consumes only very little energy, and so only negligible additional operating costs arise to this extent. At measured current densities of <10 $\mu A/cm^2$, closed-circuit currents are set up in the passivation mode which are lower by orders of magnitude than the values of 1.5 mA permissible in the automobile sector.

Silver-containing conductor structures can now be implemented in the automobile sector on the outer side of the window panes for sensors or other applications in the wet area without being masked. It is possible in the construction sector for printed rain or breakage sensors to be fitted on the outer panes of, for example, roof windows. The costs for applying the protecting voltage to the structures are comparatively low.

It is possible, if appropriate, to dispense with firing on printed structures with the general aim of increasing their mechanical and chemical toughness. The point is that the use of substances other than glass, for example plastic panes, is simplified.

The operation of sensor structures can be combined very advantageously with the electrical passivation when the sensor operating voltage or measuring voltage which is required in any case is shifted into the range of the passivating voltage. To date, the relationship discussed here has not been taken into account, and the sensors with the customary available electronics have been operated at a voltage of approximately 3 V ~. However, this voltage value does not have a protecting, passivating effect. Again, the customary frequencies for these measuring AC voltages are lower than the optimum frequencies. The empirically determined passivation range occurs for voltage values of much less than 3 V. An optimum (minimal corrosion current) was found at 1.1 V and a frequency of 3000 Hz in conjunction with a sinusoidal voltage profile, and statistically assured.

While it is possible for the optimal voltage level to be uniquely defined, it cannot be excluded with regard to the frequency that a similar protective action or low corrosion currents will be set up even at frequencies of more than 3 kHz.

For the purpose of preparing tests of practical relevance, in particular the salt spray test in accordance with DIN 50021, with printed conductive surface structures susceptible to corrosion, the first step was to determine the passive region of the material. Produced for this purpose was a series of sample electrodes in which the material for the surface structures was applied to the substrate in a planar fashion by screen printing. The screen-printed glaze consists of a glass frit as carrier material, silver as electrically conducting metal with a content of 80%, and pigments, if appropriate.

The following setup, known per se, is used for the potentiodynamic experiments:

A measurement cell comprises a container with a 5 percent sodium chloride solution. Dipped into the solution are a working electrode made from the material to be investigated, a counterelectrode made from platinum, and a reference electrode (silver/silver chloride electrode), the potential at the reference electrode being tapped via a Haber-Luggin capillary. Suitable units (potentiostat for DC voltage, function generator for AC voltage) were used respectively for the DC voltage and AC voltage experiments. Finally, a measurement computer with suitable software was used for signal evaluation.

The first step was to apply DC voltages in the range from 0 to 4 V (between the sample electrodes and the counterelectrode) to the samples dipped into this measuring cell.

There is firstly a need to determine a suitable time interval for traversing the said voltage range. It turned out in the case of an excessively rapid traversal of the said voltage bandwidth (2 hours) that no pronounced passivation range was formed even though there was a slight decrease in the corrosion current at approximately 2 V=. By contrast, given a run time of 48 hours the corrosion was already so far advanced before passivation was reached, or the material was destroyed to such an extent that it was likewise impossible to determine any passivation range.

Finally, the pronounced passivation range of the material under investigation was found between approximately 0.75 and 1.8 V given a time interval of 12 hours for traversing the voltage bandwidth from 0 to 4 V=.

The corrosion behaviour was then investigated for operation with an AC voltage in the reduced passivation range thus found between 0.75 and 1.8 V.

There is a fundamentally clear rise in the corrosion currents when a mixed voltage (DC voltage with superimposed AC voltage) is applied to samples which are produced in the same way and are to be regarded as mutually identical in the context of industrial production. However, a contrary development was found at a frequency of 3000 Hz.

This was confirmed by further experiments with pure AC voltage. It turned out here that pure AC voltage fundamentally effected better protection or a more pronounced reduction in the corrosive current than DC voltage or mixed voltage.

The experiments were therefore continued using real exemplary patterns, specifically humidity sensors with comb electrodes printed on glass panes, an AC voltage of 1.1 V being applied at 3 kHz to these comb electrodes during the salt spray test.

The degree of corrosion of the sample structures increased continuously during the test period. The advance of the corrosion was not yet concluded even after a residence duration of 240 h. It was possible, nevertheless, to verify that the capacity of the comb electrodes which is important for the sensor function was not reduced to ineffective values. This means that the service life of the conductive structures will meet the requirements completely, disregarding a scarcely visible external corrosion of the electrodes under normal weathering and the real conditions of use.

The invention claimed is:

1. A method for protecting at least two metal-containing structures applied to a substrate against corrosive attacks, the method comprising:

applying at least temporarily to one of the at least two metal-containing structures an electric passivation voltage in a range of passivation of a conductive material of the one of the least two metal-containing structures, wherein a potential difference between the one of the at least two metal-containing structures and another of the at least two-metal containing structures is at a level of the electric passivation voltage.

2. A method according to claim 1, further comprising:

using the electric passivation voltage simultaneously as a measuring voltage for a sensor.

3. A method according to claim 2, wherein the sensor is a capacitively operating moisture sensor.

4. A method according to claim 1, wherein a sinusoidally oscillating AC voltage is used as the passivation voltage.

5. A method according to claim 4, wherein an amplitude of the passivation voltage is between 0.75 V and 1.75 V.

6. A method according to claim 5, wherein the amplitude of the passivation voltage is 1.1 V.

7. A method according to claim 4, wherein a frequency of the passivation voltage is above 2000 Hz.

8. A method according to claim 7, wherein the frequency of the passivation voltage is between 2000 and 4000 Hz.

9. A method according to claim 1, wherein the at least two metal-containing structures applied to the substrate are included in one of a moisture sensor, a breakage sensor, an antenna, and a heating conductor.

10. A method according to claim 9, wherein the substrate is one of a glass or plastic pane.

* * * * *